United States Patent [19]

Cuzzone

[11] 4,172,246

[45] Oct. 23, 1979

[54] ELECTRIC FUSE FOR BOLT OR CLIP MOUNTING

[75] Inventor: Raymond Cuzzone, Hickory, N.C.

[73] Assignee: General Electric Company, Philadelphia, Pa.

[21] Appl. No.: 908,349

[22] Filed: May 22, 1978

[51] Int. Cl.[2] ..... H01H 85/52

[52] U.S. Cl. ..... 337/191; 337/214

[58] Field of Search ..... 337/191, 192, 193, 207, 337/213, 214, 215, 244

[56] References Cited

U.S. PATENT DOCUMENTS

| | | | |
|---|---|---|---|
| 1,955,251 | 4/1934 | Ohlson | 337/215 X |
| 1,987,181 | 1/1935 | Condon | 337/215 |
| 4,023,133 | 5/1977 | Knapp, Jr. | 337/244 X |

*Primary Examiner*—George Harris

*Attorney, Agent, or Firm*—William Freedman; Carl L. Silverman

[57] ABSTRACT

An electric fuse includes a cylindrical insulating housing with conductive terminal caps at opposing ends of the housing. Conductive ferrules are adjacent the terminal caps and electrically connected thereto. At least one main fusible element is disposed between the terminal caps and electrically connects the terminal caps. The ferrules are of a cylindrical configuration such that the fuse is operational through clip mounting of the ferrules. Bolt receiving means is provided for bolt mounting the fuse between a pair of conductive mounting bus bars. The bolt receiving means comprises a plurality of internally threaded passageways for securely receiving a threaded bolt. Each of the passageways respectively extends generally longitudinally inwardly through each of the terminal caps. The presence of the bolt receiving means presents substantially no impediment to the clip mounting operation of the fuse.

7 Claims, 5 Drawing Figures

ELECTRIC FUSE FOR BOLT OR CLIP MOUNTING

BACKGROUND OF THE INVENTION

This invention relates to an electric fuse, and more particularly to such a fuse which can be bolt mounted or clip mounted.

Current limiting power fuses generally have a cylindrical housing of insulating material which is closed at each end by a metal terminal cap. A main fusible element(s), usually a silver ribbon, extends inside the housing between the terminal caps. The space around the fusible element is filled with silica sand. When current through the fuse exceeds the rating of the fuse for a sufficient time, the element melts, or fuses at one or more points, causing the formation of an arc. The arc progressively melts the sand and forms channels of fulgurite in it. The relatively high resistance fulgurite eventually suppresses any significant flow of current through the fuse.

The melting of the main fusible element is generally silent, and hence, not noticeable. Thus, it is common to provide indicating means by which it can be readily determined if the main fusible element has melted. Generally, such indicating means include movable indicator mechanisms such as those described in U.S. Pat. No. 3,895,338, issued July 15, 1975 to Gray et al and assigned to the assignee of the present application, and in U.S. Pat. No. 2,797,279, issued June 25, 1967 to Brandt et al.

In operation, such fuses are generally clip mounted or bolt mounted, depending upon the particular application. Both clip mounting and bolt mounting operation exhibit advantages and disadvantages.

Presently, most fuses are clip mounted wherein spring loaded clips firmly grasp conductive cylindrical ferrules which are disposed in electrically contacting relation adjacent to the fuse terminal caps. Such clip mounted fuses can be simply inserted and removed. However, for some fuse applications, the clip mounted fuse exhibits several disadvantages. One such disadvantage arises as a result of space limitations in the electrical cabinet in which the fuses are installed. More particularly, in order for a fuse clip to make good electrical contact to the fuse ferrule, the clip must be rather rugged. Also, in order to provide the simple insertion/-removal feature of the clip mounted fuse, the clip structure generally includes protruding ears. The protruding ears function to guide the ferrules during fuse insertion, allowing the clip to open and then properly seat the ferrules. In view of the foregoing, where space limitations exist, the presence of such a clip structure is undesirable. Another disadvantage associated with the use of clip mounted fuses is that it is generally impractical to clip mount a second fuse, i.e., couple a second fuse to the first fuse. Such coupling is desirable for those situations in which the current rating of the first clip mounted fuse is too small.

Bolt mounted fuses are generally bolted between a pair of conductive mounting bus bars. An advantage of such a bolt mounted fuse is that bolt mounted fuses generally provide tighter electrical contact surfaces than clip mounted fuses. As a result, bolt mounted fuses usually exhibit reduced heating as compared to clip mounted fuses. Another advantage of a bolt mounted fuse is that it is generally convenient to bolt mount a second fuse in those situations in which the current rating of the first bolt mounted fuse is too small.

Whether the fuse is clip mounted or bolt mounted, in successfully performing their intended function, such fuses have to be replaced. There is little problem in obtaining a replacement fuse for a clip mounted fuse or a replacement fuse for a bolt mounted fuse. However, there is a significant problem in obtaining a single space conserving replacement fuse which can be either clip mounted or bolt mounted. In this connection, although additional bolt mounting structure could be added to the widely employed clip mounted fuse, such structure would undesirably increase the size of the fuse. Also, such additional bolt mounting structure generally presents impediments which make clip mounting of such a fuse impractical. Further, such additional bolt mounting structure may require additional processing of the clip mountable fuse, i.e., welding, brazing or soldering, in order to modify the clip mounting fuse to make it suitable for bolt mounting operation. Such additional processing is undesirable as it increases the assembly cost of the fuse.

Accordingly, it is a general object of this invention to provide an electric fuse which can be either clip mounted or bolt mounted.

It is another object of this invention to provide such a fuse in which the bolt mounting feature is obtained without increasing the size of the clip mounted fuse.

It is another object of this invention to provide such a fuse in which the bolt mounting feature is obtained through processing which does not require welding, brazing or soldering.

SUMMAY OF THE INVENTION

In carrying out one form of my invention, I provide an electric fuse of the type including a cylindrical insulating housing with conductive terminal caps at opposing ends of the housing. Conductive ferrules are disposed adjacent the terminal caps and electrically connected thereto. The ferrules are of a cylindrical configuration such that the fuse is operational through clip mounting of the ferrules. At least one main fusible element is disposed between the terminal caps and electrically connects the terminal caps. The fusible element is surrounded by an interruping medium. Bolt receiving means is provided for bolt mounting the fuse between a pair of conductive mounting bus bars. The bolt receiving means includes at least one passageway respectively extending generally longitudinally inwardly through an aperture in each one of the terminal caps. The passageway includes internal threads for securely receiving a threaded bolt and is closed at its inner end. The presence of the bolt receiving means presents substantially no impediment to the clip mounting operation of the fuse wherein the fuse is operational through either clip mounting or bolt mounting.

BRIEF DESCRIPTION OF THE DRAWINGS

My invention will be more fully understood and its several objects and advantages further appreciated by referring now to the following description, taken in conjunction with the accompanying drawings, wherein.

DETAILED DESCRIPTION OF THE INVENTION

Figure 1:
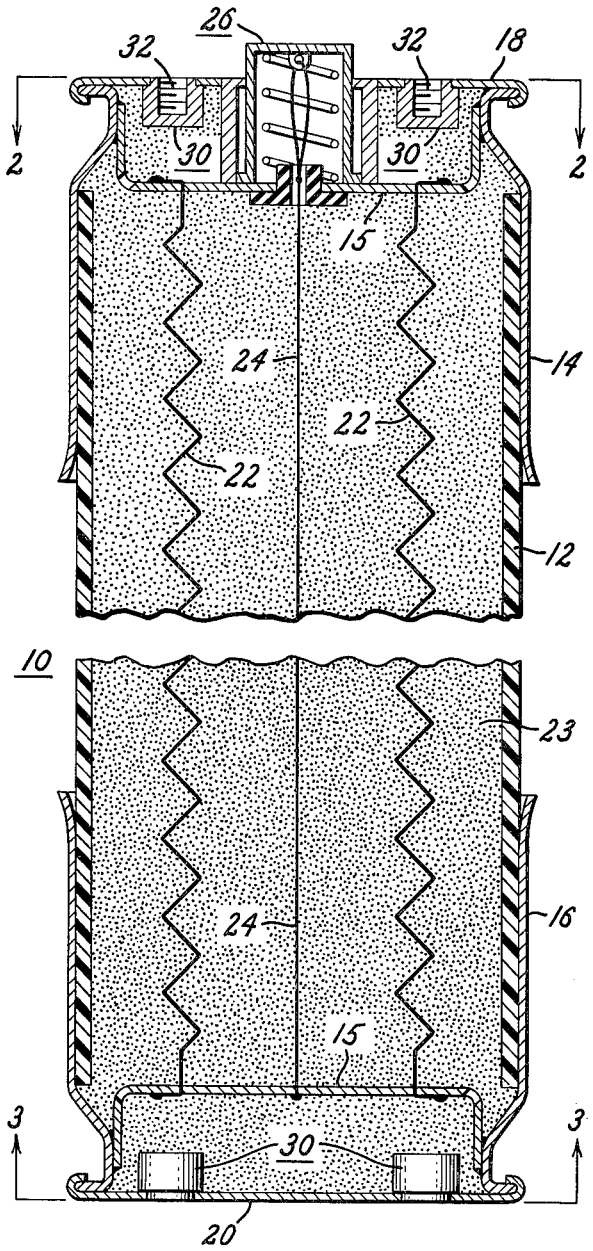
FIG. 1 is a partially cut away sectional view of one form of electric fuse of the present invention.

Referring initially to FIG. 1, one form of electric fuse of the present invention is generally designated 10. The fuse 10 includes a cylindrical insulating housing 12 of a material such as fiberglass. An upper conductive ferrule 14 is at one end of the housing 12 and a lower conductive ferrule 16 is at the other end. The conductive ferrules 14, 16 are cylindrical in configuration and may, for example, be of a material such as brass or copper. The inner walls of ferrules 14, 16 are electrically connected to conductive cup-shaped element supports 15 through a weld joint. The element supports 15 may, for example, be of a material such as tin-plated copper. The end openings of the upper and lower ferrules 14, 16 are closed by upper and lower conductive end terminal caps 18, 20 respectively. Two fusible ribbon conductors 22, of a material such as silver, comprise the main fusible element. The ribbon conductors 22 are disposed between the conductive element supports 15 which electrically contact the ferrules 14, 16, and hence, the terminal caps 18, 20. The space around the fusible conductors 22 is substantially filled with an interrupting medium, such as finely divided sand 23, so as to surround the fusible conductors 22.

Also disposed within the housing 12 is an auxiliary fusible element 24 which is chosen to be of a material such that the fusible element 24 has a higher resistance than the fusible element 22. Exemplary materials for the fusible element 24 include the one available under the trademak Nichrome. One end of the fusible element 24 is connected to lower conductive element support 15. The upper end of the auxiliary fusible element 24 is coupled to an indicator mechanism 26. The indicator mechanism 26 is of the type which typically includes a spring biased movable button. One such indicator mechanism is shown in previously mentioned U.S. Pat. No. 3,895,338, issued July 15, 1975 and assigned to the assignee of the present application. This patent is hereby incorporated by reference in the present application.

To this point in description, the electric fuse 10 is of a conventional configuration which makes it suitable for operation through clip mounting wherein clips (not shown) firmly grasp the conductive ferrules 14, 16.

Figure 2:
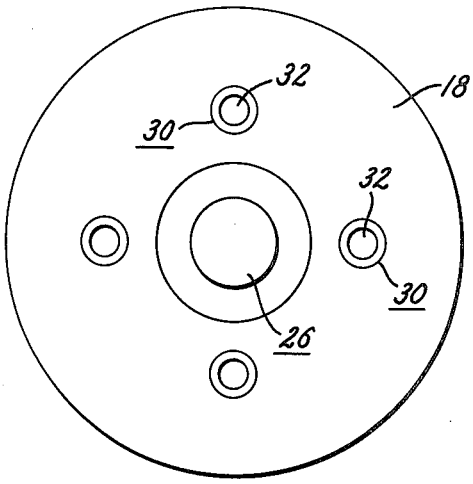
FIG. 2 is a plan view of the electric fuse of FIG. 1, taken along line 2—2 of FIG. 1.
Figure 3:
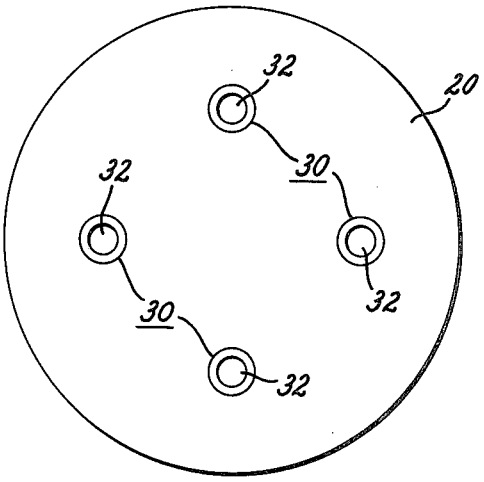
FIG. 3 is a plan view of the electric fuse of FIG. 1, taken along line 3—3 of FIG. 1.

The bolt mounting feature of the electric fuse 10 of the present invention will now be described. Bolt receiving means 30, including bolt receiving passageways 32, are provided in the terminal caps 18, 20. More particularly, in one form of electric fuse of the present invention, the bolt receiving means 30 comprises a plurality of passageways 32 which extend longitudinally inwardly through the terminal caps 18, 20. In a preferred embodiment, as shown in FIGS. 1-3, four such passageways 32 are provided in uniform radial relation about the centers of the terminal caps 18, 20. Each of the passageways 32 includes internal threads and is of a configuration which is adapted to securely receive a threaded bolt (not shown). It is to be appreciated that the bolt receiving means 30 presents no impediment to conventional clip mounting of the fuse 10.

Figure 4:
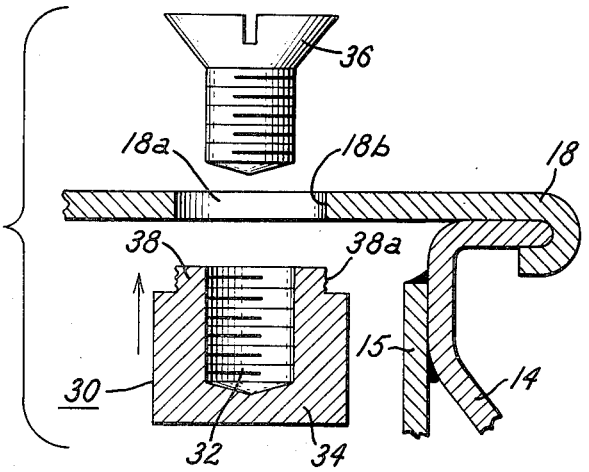
FIG. 4 is an enlarged sectional view of a portion of the electric fuse of FIG. 1.

Referring now to FIG. 4, the bolt receiving means 30 of FIGS. 1-3 is shown in more detail. The bolt receiving means 30 shown in FIG. 4 is of the press-fit type, sometimes termed "clinch nut". More particularly, the bolt receiving means 30 includes a housing 34 which includes an internally threaded passageway 32 which is closed at one end. The closed end ensures the containment of the interrupting medium 23. The internally threaded passageway 32 is dimensioned to securely receive a threaded bolt 36. The housing 34 is preferably of a sturdy material such as tin-plated steel so as to reduce the likelihood of thread stipping. The housing 34 includes clinching portions 38 disposed at the open end of the passageway 32. The clinching portions 38 include serrated surfaces 38*a*. The configuration and outer dimension of the clinching portions 38 is selected to closely match the corresponding configuration and dimension of an aperture 18*a* in the terminal cap 18. When the clinching portions 38 and housing 34 are inserted in press-fit fashion (in the direction shown by the arrow in FIG. 4) into the terminal cap aperture 18*a*, the serrated surfaces 38*a* engage the edge surfaces 18*b* of the terminal cap 18. This causes the clinching portions 38 to lock the housing 34 into the position shown in FIG. 1. It is to be appreciated that the bolt receiving means 30 shown in FIG. 4 requires no welding, brazing or soldering in its fabrication.

Figure 5:
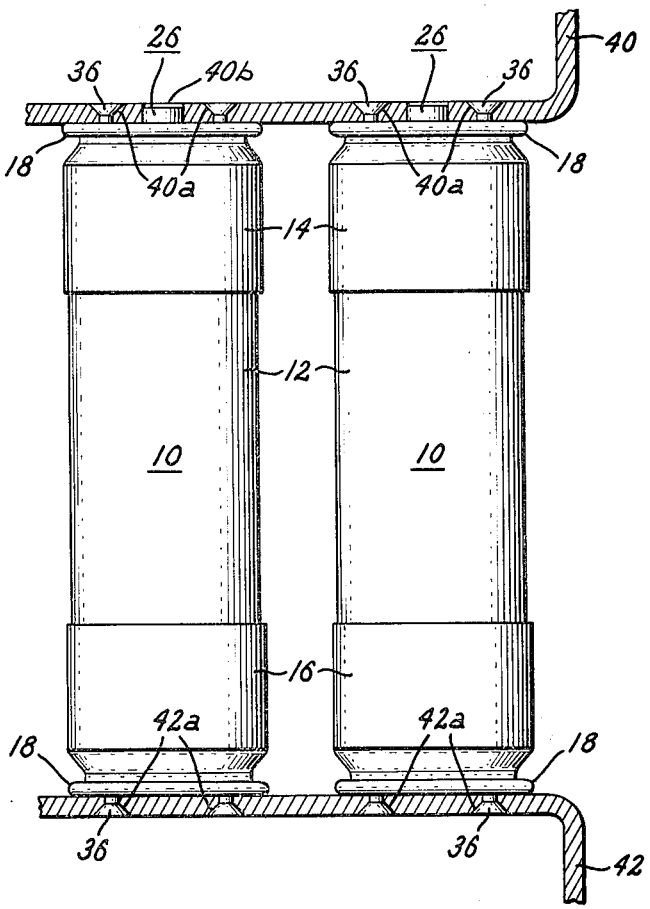
FIG. 5 is a partially cut away sectional view showing a pair of electric fuses of the present invention operationally bolted between a pair of mounting bus bars.

Referring now to FIG. 5, two electric fuses 10 of the present invention are shown operationally coupled together to increase the current rating of the individual fuses. More particularly, a pair of electric fuses 10 of the present invention are operationally bolted to a pair of conductive bus mounting bars 40, 42. Such mounting bus bars 40, 42 are commonly employed in the electrical industry and are conveniently shaped to satisfy a users requirements. One of the mounting bus bars 40 is bolted to the terminal caps 18 and the other mounting bus bars 42 is bolted to the terminal caps 20. Each mounting bus bar 40, 42 includes appropriately positioned apertures (40*a*, 40*b*, 42*a*) for receiving securing bolts 36 and for permitting the indicator mechanisms 26 to pass therethrough. As can be appreciated, when the bolts 36 are tightened, the result is that each of the electric fuses 10 is operational through a bolted connection to the mounting bus bars 40, 42. It is to be appreciated that this bolt mounting capability of the electric fuse 10 is provided while preserving the clip mounting capability of the same electric fuse. Therefore, the electric fuse 10 of the present invention is suitable as a replacement fuse for both a clip mounted fuse and a bolt mounted fuse. Further, it is to be noted that the coupling of the fuses 10 shown in FIG. 5 is done in a desirable space conserving manner. Indeed, by providing appropriate mounting bus bars, the use of the electric fuse 10 of the present invention allows the user to conveniently add or subtract fuses in order to obtain a desired fuse rating.

Although the electric fuse of the present invention has been illustrated in connection with a fuse having a particular indicator mechanism, it is to be appreciated that other indicator mechanisms may be substituted therefor. For example, one preferred form of indicator mechanism is disclosed and claimed in my copending application of Ser. No. 870,708 entitled "Electric Fuse with Indicating Means", filed Jan. 19, 1978, and assigned to the assignee of the present invention. Indeed, although preferable for many applications, it is not necessary that the electric fuse of the present invention include an indicator mechanism. Also, the particular structure of the bolt receiving means may vary in accordance with the users requirements. In this connection it is to be appreciated that the number and size of the bolt receiving passageways may also vary in accordance with the particular fuse application.

While I have illustrated preferred embodiments of my invention, many modifications will occur to those skilled in the art and I therefore wish to have it understood that I intend in the appended claims to cover all such modifications as fall within the true spirit and scope of my invention.

What I claim as new and desire to secure by Letters Patent of the United States is:

1. An electric fuse of the type including a cylindrical insulating housing, conductive terminal caps at opposing ends of the housing, conductive ferrules disposed adjacent the terminal caps and electrically connected thereto, the ferrules being of a cylindrical configuration such that the fuse is operational through clip mounting of the ferrules, at least one main fusible element disposed between the terminal caps and electrically connecting the terminal caps, the fusible element being surrounded by an interrupting medium, wherein the improvement comprises:

bolt receiving means for bolt mounting said fuse between a pair of conductive mounting bus bars, said means including at least one passageway respectively extending generally longitudinally inwardly through an aperture in each one of said terminal caps, said passageway including internal threads for securely receiving a threaded bolt, said passageway being closed at its inner end, the presence of said bolt receiving means presenting substantially no impediment to said clip mounting operation of said fuse wherein said fuse is operational through either said clip mounting or said bolt mounting.

2. An electric fuse in accordance with claim 1 in which said bolt receiving means comprises press-fit means, said press-fit means including a housing having therein said internally threaded passageway, said housing including clinching portions at the open end of said passgeway, said clinching portions including serrated surfaces and being of a configuration which closely matches said aperture in said terminal cap such that said serrated surfaces engage said terminal cap adjacent said aperture in locking manner.

3. An electric fuse in accordance with claim 2 in which substantially no portion of said bolt receiving means extends longitudinally outwardly beyond said terminal caps.

4. An electric fuse in accordance with claim 3 in which said housing comprises tin-plated steel.

5. An electric fuse in accordance with claim 3 in which each of said terminal caps includes a plurality of said bolt receiving passageways.

6. An electric fuse in accordance with claim 5 in which at least one of said terminal caps includes a movable indicator button disposed along the longitudinal axis of said fuse and in which said bolt receiving passageways are disposed in uniform radial relation around said movable indicator button.

7. At least two electric fuses in accordance with claim 3, said fuses being coupled together to increase the current rating of the individual fuses, said fuses being bolt mounted between said pair of conductive mounting bus bars.

* * * * *